US007980206B2

(12) United States Patent
Nagafuchi

(10) Patent No.: US 7,980,206 B2
(45) Date of Patent: Jul. 19, 2011

(54) COOLING WATER PASSAGE STRUCTURE OF CYLINDER HEAD

(75) Inventor: Hiroki Nagafuchi, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 460 days.

(21) Appl. No.: 12/297,363

(22) PCT Filed: Aug. 27, 2007

(86) PCT No.: PCT/JP2007/067086

§ 371 (c)(1),
(2), (4) Date: Oct. 16, 2008

(87) PCT Pub. No.: WO2008/026746

PCT Pub. Date: Jun. 3, 2008

(65) Prior Publication Data

US 2009/0084332 A1 Apr. 2, 2009

(30) Foreign Application Priority Data

Aug. 28, 2006 (JP) ..... 2006-230857

(51) Int. Cl.
*F02F 1/36* (2006.01)
*F02F 1/42* (2006.01)

(52) U.S. Cl. ..... 123/41.82 R; 123/193.5; 60/320

(58) Field of Classification Search .... 123/193.1–193.6, 123/188.9, 41.17, 41.31, 41.72, 41.82 R, 123/41.82 A, 41.79, 41.8; 60/320, 321
See application file for complete search history.

(56) References Cited

U.S. PATENT DOCUMENTS

| | | | | |
|---|---|---|---|---|
| 2,963,007 | A * | 12/1960 | Leach | 123/41.74 |
| 4,590,894 | A * | 5/1986 | Ishida et al. | 123/41.74 |
| 4,600,527 | A * | 7/1986 | Imazeki et al. | 252/299.1 |
| 5,095,704 | A | 3/1992 | Nagura et al. | |
| 5,836,272 | A * | 11/1998 | Sakurai | 123/41.82 R |
| 6,412,451 | B2 * | 7/2002 | Kuga et al. | 123/41.72 |
| 6,799,540 | B2 * | 10/2004 | Akiwa et al. | 123/41.82 R |
| 6,823,823 | B2 * | 11/2004 | Kim | 123/41.74 |
| 6,827,049 | B2 * | 12/2004 | Oh | 123/41.82 R |
| 2002/0026909 | A1 | 3/2002 | Akiwa et al. | |
| 2005/0039706 | A1 * | 2/2005 | Yamamoto | 123/41.74 |

FOREIGN PATENT DOCUMENTS

| | | | |
|---|---|---|---|
| EP | 448525 | A1 * | 9/1991 |
| EP | 0 816 662 | A1 | 1/1998 |
| JP | 60-1358 | | 1/1985 |

(Continued)

*Primary Examiner* — Michael Cuff
*Assistant Examiner* — Hung Q Nguyen
(74) *Attorney, Agent, or Firm* — Finnegan, Henderson, Farabow, Garrett & Dunner, LLP

(57) ABSTRACT

In an internal combustion engine, one end of a cylinder head (1) in a longitudinal direction is provided with a cooling water inflow port (19) leading to the inside of the cylinder head (1), while the other end of the cylinder head (1) in the longitudinal direction is provided with an outflow port (20) of main cooling water flow (X) flowing through the center inside the cylinder head (1). Further, an outflow port (21) of sub cooling water flows (Y) branched from the main cooling water flow (X) and flowing around the merged part of the exhaust port (5) is provided. An adapter (23) communicated with the main cooling water outlet (20) and sub cooling water outlet (21) and combining these outflow ports (20, 21) into a single cooling water outlet (22) is fixed to the outer wall surface of the cylinder head (1).

3 Claims, 3 Drawing Sheets

FOREIGN PATENT DOCUMENTS

| | | |
|---|---|---|
| JP | 2709815 | 10/1997 |
| JP | 2000-328942 | 11/2000 |
| JP | 2002-70551 | 3/2002 |
| JP | 3569636 | 6/2004 |

* cited by examiner

COOLING WATER PASSAGE STRUCTURE OF CYLINDER HEAD

TECHNICAL FIELD

The present invention relates to a cooling water passage structure of a cylinder head.

BACKGROUND ART

In four-cylinder internal combustion engines, there is known an internal combustion engine in which exhaust ports of the cylinders are merged with each other inside the cylinder head and in which cooling water fed from inside the cylinder block to the inside of the cylinder head is led near the merged parts of the exhaust ports formed in the cylinder head, passes through single cooling water outlets, and is discharged to the outside (see Japanese Patent No. 2709815). In this internal combustion engine, the merged parts of the exhaust ports becoming a high temperature in the cylinder head are cooled by the cooling water, so the merged parts of the exhaust ports can be prevented from overheating.

However, when feeding cooling water discharged from the cylinder head to a radiator, to streamline the piping of the cooling water from the cylinder head to the radiator, usually the cooling water outlets of the cylinder head are combined into one. However, when cooling the merged parts of exhaust ports as a whole homogeneously and directing the cooling water to a single cooling water outlet, the structure of the passages of the cooling water in the cylinder head becomes extremely complicated and, as a result, not only does the flow channel resistance of the cooling water increase, but also the problem arises of a greater number of steps and cost for production of the cylinder head.

DISCLOSURE OF THE INVENTION

An object of the present invention is to provide a cooling water passage structure of a cylinder head enabling streamlining of the cooling water passages inside the cylinder head.

According to the present invention, there is provided a cooling water passage structure of a cylinder head in an internal combustion engine where cylinders are arranged in series in a longitudinal direction of the cylinder head and where exhaust ports of at least one pair of cylinders are merged with each other inside the cylinder head, wherein one end of the cylinder head in the longitudinal direction is provided with a cooling water inflow port leading to the inside of the cylinder head, the other end of the cylinder head in the longitudinal direction is provided with an outflow port of main cooling water flow flowing through a center of the cylinder head and is provided with an outflow port of sub cooling water flows branched off from the main cooling water flow and flowing around the merged part of the exhaust ports located at a side part of the cylinder head, and an adapter communicated with the outflow port of the main cooling water flow and the outflow port of the sub cooling water flows and combining these outflow ports into a single cooling water outlet is fixed to an outer wall surface of the other end of the cylinder head.

That is, if using such an adapter, the production cost rises by that amount, so usually such an adapter is not used. However, if using such an adapter, it is possible to streamline the cooling water flow channels inside the cylinder head, so there is a far greater advantage compared with the above-mentioned known internal combustion engine.

BEST MODE FOR CARRYING OUT THE INVENTION

Figure 1:
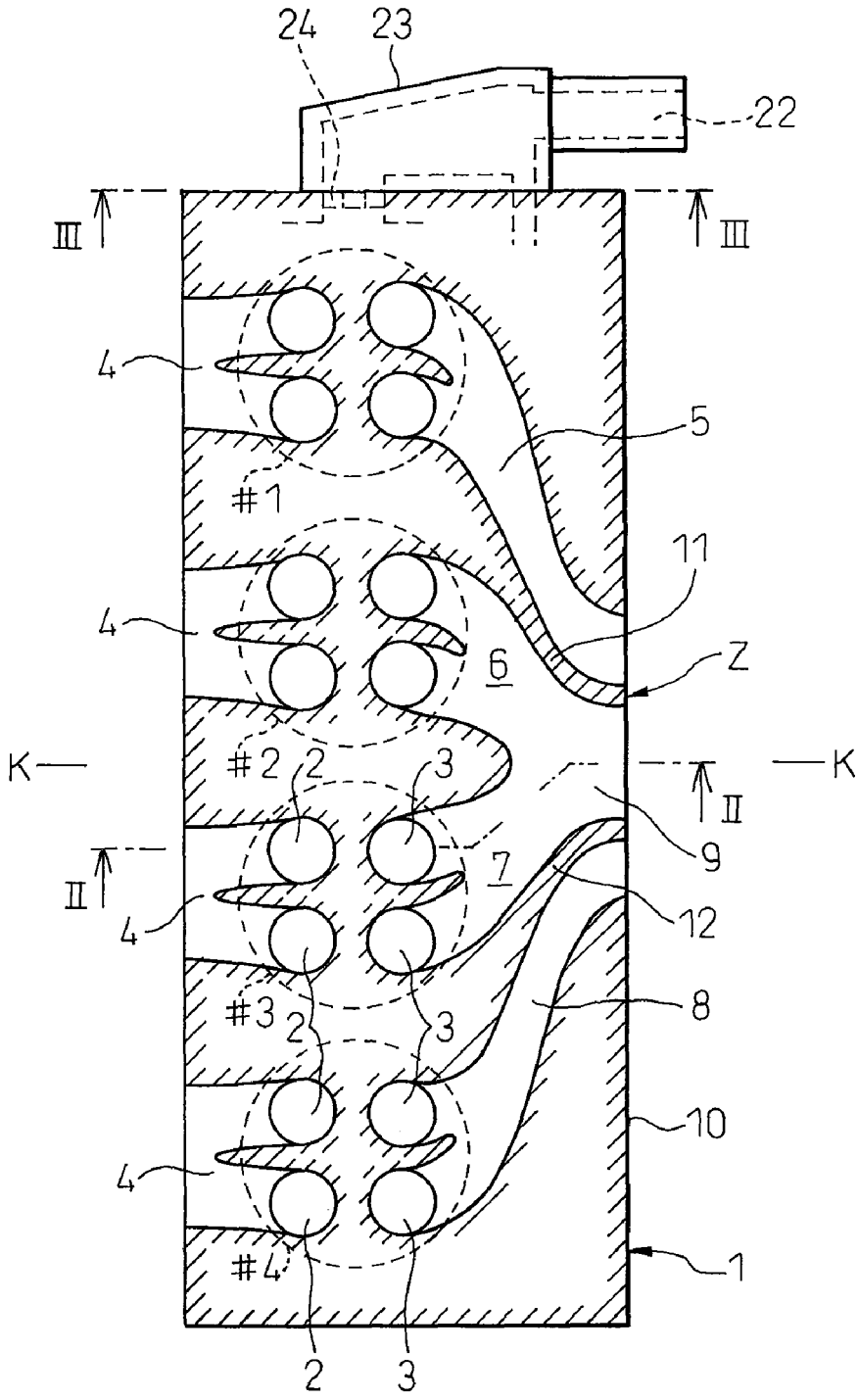
FIG. 1 is a plan cross-sectional view of a cylinder head.
Figure 2:
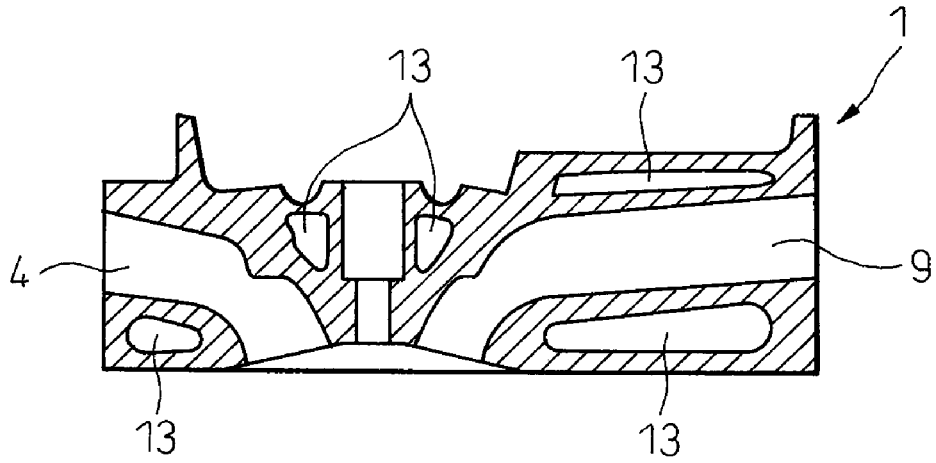
FIG. 2 is a cross-sectional view of a cylinder head as seen along the line II-II of FIG. 1.

FIG. 1 and FIG. 2 show a cylinder head 1 integrally cast from for example an aluminum alloy. Note that in FIG. 1, the circles shown by the broken lines show the positions of the No. 1 cylinder #1, the No. 2 cylinder #2, the No. 3 cylinder #3, and the No. 4 cylinder #4, therefore, it is learned that the internal combustion engine provided with the cylinder head 1 shown in FIG. 1 is an in-line four-cylinder internal combustion engine. In FIG. 1, 2 indicates a valve port opened and closed by an intake valve, while 3 indicates a valve port opened and closed by an exhaust valve. Therefore, it is learned that each of the cylinders #1, #2, #3, and #4 is respectively provided with a pair of intake valves and a pair of exhaust valves.

The cylinder head 1 is formed with intake ports 4 corresponding to the cylinders #1, #2, #3, and #4. Further, the cylinder head 1 is formed with exhaust ports 5 for the No. 1 cylinder #1, exhaust ports 6 for the No. 2 cylinder #2, exhaust ports 7 for the No. 3 cylinder #3, and exhaust ports 8 for the No. 4 cylinder #4. As will be understood from FIG. 1, the exhaust ports 5, 6, 7, and 8 are separate near the corresponding pairs of valve ports 3, but become single exhaust ports when separating from the valve ports 3.

Now, as will be understood from FIG. 1, the exhaust ports of the pair of cylinders positioned at the center, that is, the exhaust ports 6 of the No. 2 cylinder #2 and the exhaust ports 7 of the No. 3 cylinder #3, are merged with each other inside the cylinder head 1 to form a single merged exhaust port 9. This merged exhaust port 9 extends to the side wall surface 10 of the cylinder head 1. In FIG. 1, if the plane extending through the center between the No. 2 cylinder #2 and No. 3 cylinder #3 in the cylinder axial line direction and perpendicular to the plane including the cylinder axial lines of the cylinders #1, #2, #3, and #4 is referred to as the "symmetrical plane K-K", the exhaust ports 6 of the No. 2 cylinder #2 and the exhaust ports 7 of the No. 3 cylinder #3 are arranged symmetrically with respect to the symmetrical plane K-K. The merged exhaust port 9 extends along the symmetrical plane K-K to the side wall surface 10 of the cylinder head 1.

On the other hand, the exhaust ports of the pair of cylinders positioned at the two ends, that is, the exhaust ports 5 of the No. 1 cylinder #1 and the exhaust ports 8 of the No. 4 cylinder #4, are also arranged symmetrically with respect to the symmetrical plane K-K. In this case, the exhaust ports 5 of the No. 1 cylinder #1 extend from the No. 1 cylinder #1 toward the merged exhaust port 9, then extend along the merged exhaust port 9 until the side wall surface 10 of the cylinder head 1 in a state where the exhaust port 5 is separated from the merged exhaust port 9 by a thin wall 11 at the side of the merged exhaust port 9, while the exhaust ports 8 of the No. 4 cylinder #4 extend from the No. 4 cylinder #4 toward the merged exhaust port 9, then extend along the merged exhaust port 9 until the side wall surface 10 of the cylinder head 1 in a state where the exhaust port 8 is separated from the merged exhaust port 9 by a thin wall 12 at the side of the merged exhaust port 9.

Figure 4:
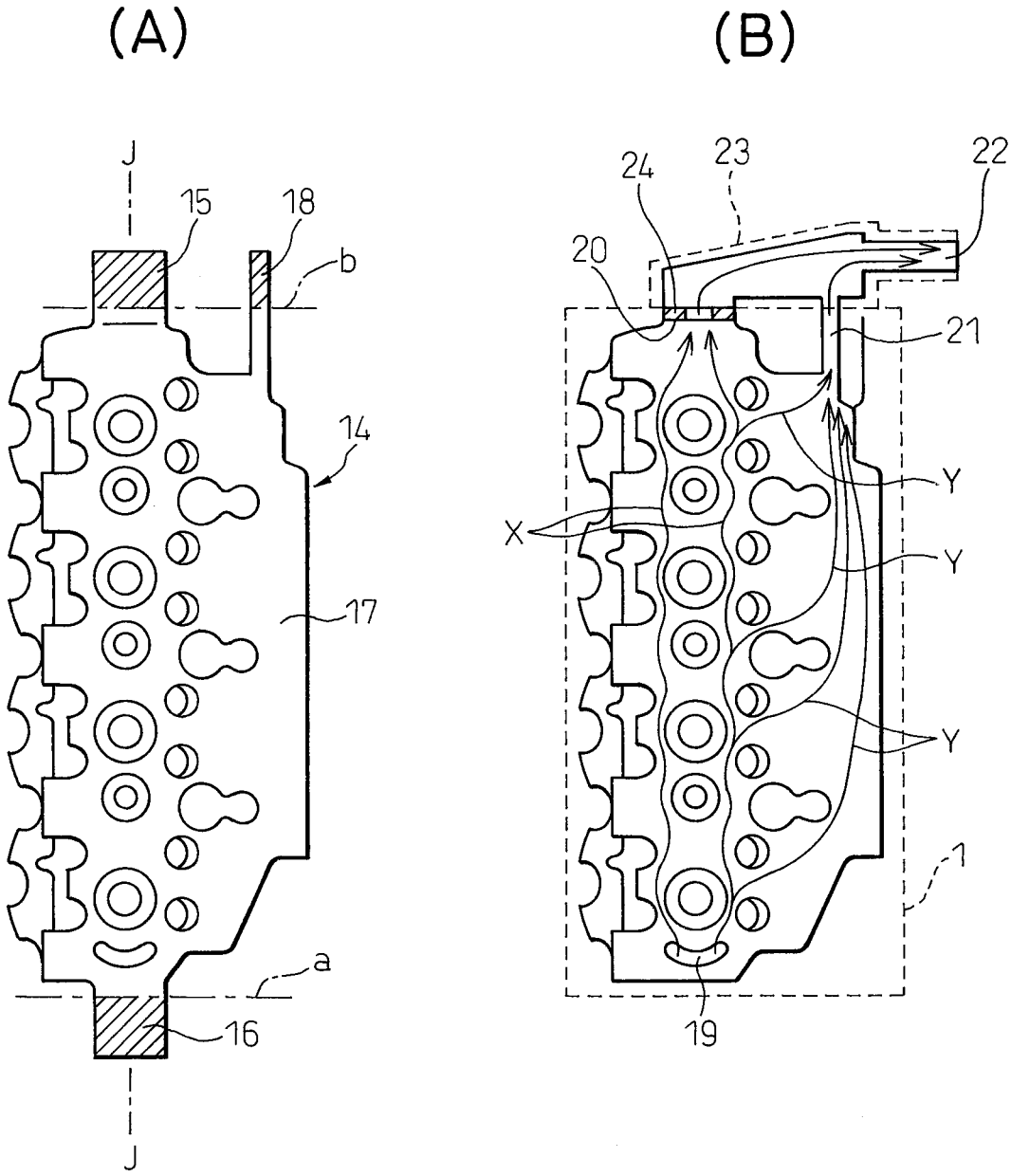
FIG. 4 is a view showing contour shapes of a core and cooling water passages.

As shown in FIG. 2, the cylinder head 1 is formed with cooling water passages 13 inside it. FIG. 4(A) shows a plan view of a core 14 used for forming the cooling water passages 13 when casting the cylinder head 1, while FIG. 4(B) shows the contour shapes of the cooling water passages 13 formed inside the cylinder head 1 using this core 14.

As shown in FIG. 4(A), the two ends of the core 14 in the longitudinal direction are formed with core support parts 15, 16 for supporting the core 14 when casting the cylinder head 1. That is, in FIG. 4(A), the a dash and a dot lines a, b show positions at the inside of the top mold and bottom mold. Therefore, the hatched regions of the core support parts 15, 16 in FIG. 4(A) are clamped between the top mold and bottom mold.

On the other hand, at the core 14, a cooling water passage region 17 extends for cooling the merged part Z of the exhaust ports (FIG. 1) at the side from the longitudinal axis J of the core 14 passing through the core support parts 15, 16. At the side of the core support part 15, a core part 18 extending from the cooling water passage region 17 substantially in parallel with the core support part 15 and with a smaller cross-sectional area than the core support part 15 is formed. This core part 18 is also clamped between the top mold and bottom mold at the time of casting of the cylinder head 1 at the hatched region.

Referring to FIG. 4(B), one end of the cylinder head 1 in the longitudinal direction is provided with a cooling water inflow port 19 leading to the inside of the cylinder head 1. Cooling water inside the cylinder block flows from this cooling water inflow port 19 to the inside of the cylinder head 1. On the other hand, the other end of the cylinder head 1 in the longitudinal direction is provided with a main cooling water outlet 20 formed by the core support part 15 and a sub cooling water outlet 21 formed by the core part 18.

Figure 3:
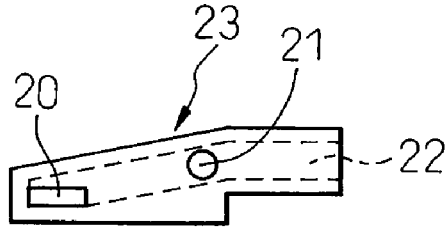
FIG. 3 is a cross-sectional view of a cylinder head as seen along the line III-III of FIG. 1.

As shown in FIG. 1, FIG. 3, and FIG. 4(B), an adapter 23 communicated with the main cooling water outlet 20 and sub cooling water outlet 21 and combining these outflow ports 20, 21 into a single cooling water outlet 22 is fixed to the outer wall surface of the cylinder head 1. The cooling water outlet 22 of this adapter 23 is connected to a radiator.

As shown by the arrow X in FIG. 4(B), the main cooling water runs from the cooling water inflow port 19 through the center part of the cylinder head 1 toward the main cooling water outlet 20. Due to this main cooling water X, the cylinders #1 to #4 are evenly cooled. On the other hand, inside the cylinder head 1, sub cooling water flows Y branching off from the main cooling water X and heading toward the cooling water passage region 17 where the merged part Z of the exhaust ports is positioned are formed. The sub cooling water flows Y flow inside the cooling water passage region 17 toward the sub cooling water outlet 21. The merged part Z of the exhaust ports is cooled by the sub cooling water Y, therefore the merged part Z of the exhaust ports is prevented from overheating.

As shown in FIG. 4(B), the main cooling water X flows straight above the cylinders #1 to #4, so the cylinders #1 to #4 are uniformly cooled while maintaining a low flow resistance. On the other hand, the sub cooling water Y is branched off a little at a time from this main cooling water flow X, so the merged part Z as a whole of the exhaust ports is uniformly cooled by the sub cooling water Y.

In the present invention, to simplify the cooling water passage structure inside the cylinder head 1, the main cooling water outlet 20 and the sub cooling water outlet 21 are separately independently formed. These outflow ports 20, 21 are combined into the single cooling water outlet 22 using the adapter 23. There is an optimal value for the ratio between the amount of main cooling water flows X and the amount of the sub cooling water flows Y branched off from the main cooling water flows X. This ratio is adjusted by a restricted opening member 24 shown in FIG. 1 and FIG. 4(B) arranged inside the main cooling water outlet 20. Note that this restricted opening member 24 has to be attached using the adapter 23 attached detachably on the cylinder head 1.

Note that if air accumulates in the cooling water passages of the cylinder head 1, the wall parts in contact with the air will not be cooled, so the cooling efficiency will drop. Therefore, it is necessary to prevent air from accumulating in the cooling water passages of the cylinder head 1. Therefore, in the embodiment according to the present invention where the sub cooling water outlet 21 is positioned between the main cooling water outlet 20 and the cooling water outlet 22, to drive out the air inside the cylinder head 1, as shown in FIG. 3, the sub cooling water outlet 21 is arranged at a position higher than the main cooling water outlet 20 and the cooling water outlet 22 is arranged at a position higher than the sub cooling water outlet 21.

LIST OF REFERENCE NUMERALS

1 cylinder head
4 intake port
5, 6, 7, 8 exhaust port
9 merged exhaust port
13 cooling water passage
14 core
19 cooling water inflow port
20 main cooling water outlet
21 sub cooling water outlet
22 cooling water outlet
23 adapter

The invention claimed is:

1. A cooling water passage structure of a cylinder head in an internal combustion engine where cylinders are arranged in series in a longitudinal direction of the cylinder head and where exhaust ports of at least one pair of cylinders are merged with each other inside the cylinder head, wherein one end of the cylinder head in the longitudinal direction is provided with a cooling water inflow port leading to the inside of the cylinder head, another end of the cylinder head in the longitudinal direction is provided with an outflow port of main cooling water flow flowing through a center of the cylinder head and is provided with an outflow port of sub cooling water flows branched off from the main cooling water flow and flowing around the merged part of the exhaust ports located at a side part of the cylinder head, and an adapter communicated with the outflow port of the main cooling water flow and the outflow port of the sub cooling water flows and combining these outflow ports into a single cooling water outlet is fixed to an outer wall surface of the other end of the cylinder head.

2. A cooling water passage structure of a cylinder head as set forth in claim 1, wherein the outflow port of said sub cooling water flows is positioned between the outflow port of said main cooling water flow and said cooling water outlet and the outflow port of said sub cooling water flows is arranged at a position higher than the output port of said main cooling water flow.

3. A cooling water passage structure of a cylinder head as set forth in claim 1, wherein a restricted opening member is inserted into the outflow port of said main cooling water flow.

* * * * *